United States Patent [19]

Mori et al.

[11] Patent Number: 4,920,353

[45] Date of Patent: Apr. 24, 1990

[54] ANTENNA FOR PORTABLE RADIO COMMUNICATION APPARATUS

[75] Inventors: Toshihiro Mori; Kazuyuki Tsunoda, both of Tokyo, Japan

[73] Assignee: NEC Corporation, Japan

[21] Appl. No.: 213,290

[22] Filed: Jun. 29, 1988

[30] Foreign Application Priority Data

Jun. 29, 1987 [JP] Japan ..... 62-159888

[51] Int. Cl.[5] ..... H01Q 1/24

[52] U.S. Cl. ..... 343/702; 343/718; 343/748

[58] Field of Search ..... 343/702, 718, 748; 455/193; 429/162, 157, 123

[56] References Cited

U.S. PATENT DOCUMENTS 3,736,591 5/1973 Rennels et al. ..... 343/702
3,918,062 11/1975 Haruki et al. ..... 343/702
4,123,756 10/1978 Nagata et al. ..... 343/702
4,590,614 5/1986 Erat ..... 343/702
4,625,212 11/1986 Oda et al. ..... 343/702

FOREIGN PATENT DOCUMENTS 3101198 9/1982 Fed. Rep. of Germany ..... 343/718
0007204 1/1985 Japan ..... 343/702

*Primary Examiner*—Rolf Hille
*Assistant Examiner*—Hoanganh Le
*Attorney, Agent, or Firm*—Ostrolenk, Faber, Gerb & Soffen

[57] ABSTRACT

An antenna for use with a miniature portable radio communication apparatus such as a paging receiver which is powered by a flat ultrathin lithium battery. At least a part of the antenna is implemented by a conductive sheath member which constitutes a positive terminal or a negative terminal of the battery.

25 Claims, 7 Drawing Sheets

ANTENNA FOR PORTABLE RADIO COMMUNICATION APPARATUS

BACKGROUND OF THE INVENTION

The present invention relates to an improvement in an antenna which is applicable to a paging receiver or like miniature portable communication apparatus.

Portable radio communication apparatuses such as paging receivers or pagers are extensively used today. This kind of apparatus mainly consists of an electric circuit arrangement including an antenna, a matching section, a radio section, and a decoder section, a battery, and a housing. In parallel with the rapid progress of microelectronics and integrated circuit technology, a demand for further miniaturization of such a portable radio communication apparatus is increasing. The key to the miniaturization is how to compound individual blocks of the apparatus. Especially, difficulty has been experienced in miniaturizing the antenna and, therefore, an improved construction, configuration and arrangement of the antenna would preferably lead to miniaturization. Although an antenna for the above application is disclosed in U.S. Pat. No. 3,736,591 (Rennels et al.) by way of example, it does not have a construction and configuration which promote the miniaturization of the whole communication apparatus.

SUMMARY OF THE INVENTION

It is therefore an object of the present invention to provide an improved antenna which contributes a great deal to the miniaturization of a portable radio communication apparatus.

In accordance with the present invention, in an antenna of a radio communication apparatus which is powered by at least one battery, at least a part of the antenna is constituted by a flat conductive sheath member which is included in the battery.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
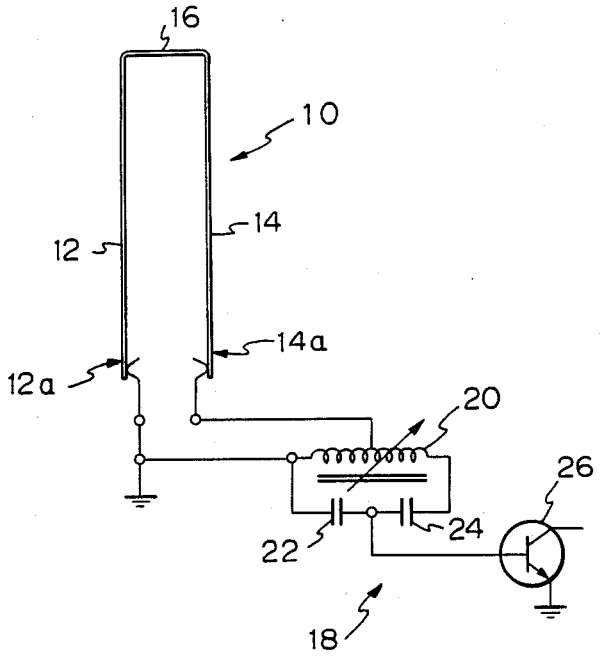
Fig. 1 PRIOR ART
FIG. 1 is a diagram schematically showing a prior art portable radio communication apparatus together with an antenna thereof.

To better understand the present invention, a brief reference will be made to an antenna of a prior art portable radio communication apparatus, shown in FIG. 1. The antenna of FIG. 1 is the antenna which is disclosed in U.S. Pat. No. 3,736,591 (Rennals et al.) as previously mentioned. As shown, the antenna 10 is generally formed in the shape of a letter U and made up of parallel flat conductive portions 12 and 14 and a conductive connecting portion 16 which electrically interconnects the flat portions 12 and 14. The ends 12*a* and 14*a* of the flat portions 12 and 14, respectively, are connected to a matching circuit 18 which includes a coil 20, capacitors 22 and 24, and a transistor 26. A radio section, a decoder and a battery and other circuit sections, not shown, are also connected to the matching circuit 18 and accommodated in a housing. A problem with such a prior art apparatus is that although the matching circuit 18, radio section, decoder and the like may be provided in a miniature configuration by integration, the whole apparatus cannot be miniaturized because no consideration is given to the antenna 10 itself, battery and housing.

The present invention contemplates to reduce the overall dimensions of a portable radio communication apparatus of the type described, by improving the construction and configuration of an antenna itself.

Figure 2:
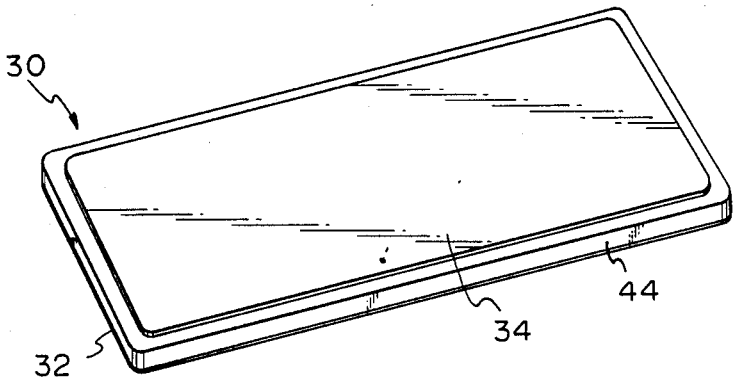
FIG. 2 is an external perspective view of an ultrathin lithium battery which is applicable to the present invention.
Figure 3:
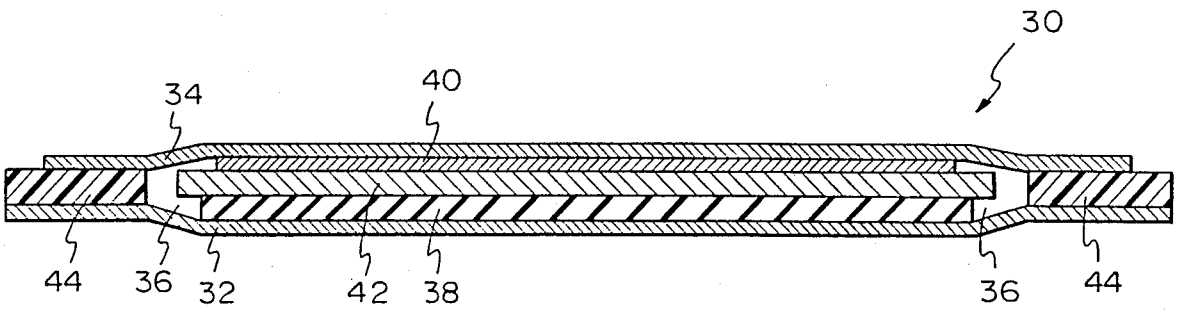
FIG. 3 is a cross-sectional side elevation of the battery shown in FIG. 2.

As shown in FIGS. 2 and 3, a portable radio communication apparatus to which an antenna of the present invention is applicable is loaded with a flat ultrathin lithium battery (e.g. CS1634 available from TOSHIBA) 30. FIG. 2 shows the battery 30 in an external view while FIG. 3 shows it in a sectional side elevation. As shown, the battery 30 is constituted by a first flat sheath portion 32 which serves as a positive terminal, a second flat sheath portion 34 which serves as a negative terminal, a positive polarity substance 38 and a negative polarity substance 40 individually received in a space 36 which is defined between the sheath portions 32 and 34, a separator 42 interposed between the two substances 38 and 40 and containing an electrolyte, and a seal member 44 sealing the opening which is defined between and along the edges of the sheath members 32 and 34.

In accordance with the present invention, the positive terminal sheath portion 32 or the negative terminal sheath portion 34 of the battery 30 is used as a part of the conductor which constitutes an antenna.

Figure 4:
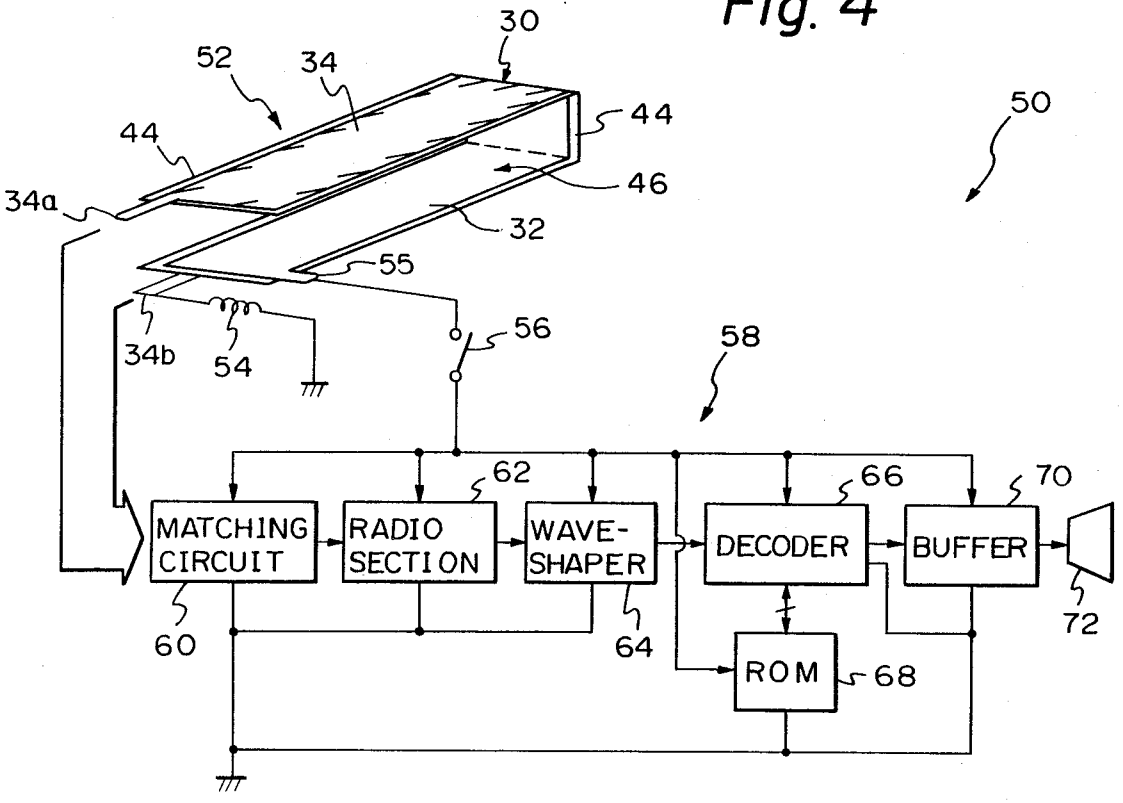
FIG. 4 is a view showing a first embodiment of the antenna in accordance with the present invention and a radio communication apparatus in which the antenna is installed.

Referring to FIG. 4, a radio communication apparatus such as a pager 50 is shown which is implemented with a first embodiment of the antenna in accordance with the present invention. As shown, a battery 30 used with the pager 50 is formed by bending the single lithium battery 30 of FIGS. 2 and 3 substantially at its intermediate portion in the form of a letter U. Either one of the positive polarity and negative polarity sheath portions 32 and 34 of the battery 30 (negative polarity sheath portion 34 in this particular embodiment) is used as a loop antenna 52 itself, i.e., as a part of the conductor which constitutes the antenna 52. As shown in FIG. 4, antenna terminals 34*a* and 34*b* extend out from the negative polarity sheath portion 34 of the battery 30, or antenna 52, to serve as feed points. A coil 54 is connected between the antenna terminal 34*b* and ground to prevent a high frequency which is induced in the negative polarity sheath portion 34 from being coupled to ground of the apparatus 50. On the other hand, the positive polarity sheath portion 32 is provided with a positive terminal 55 of the battery 30 itself. A power switch 56 is connected to the positive terminal 55.

Figure 5:
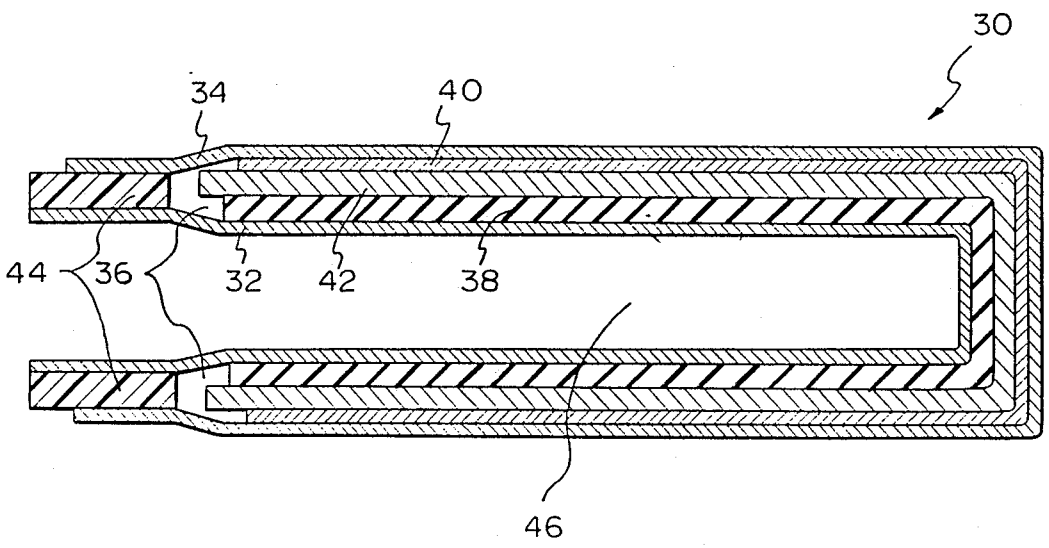
FIG. 5 is a cross-sectional side elevation of a battery which is used with the apparatus of FIG. 4 and forms a part of the antenna.

The combined battery and antenna 52 is connected to a circuit arrangement 58 which may be provided in an integrated configuration. The circuit 58 includes a matching circuit 60 which is connected to the antenna terminal 34*a* and 34*b*, a radio section 62, a wave-shaper 64, a decoder 66, a read only memory (ROM) 68 storing a paging number and like data, and a buffer 70. A loudspeaker 72 is connected to the circuit 58. The circuit 58 is integrated and accommodated in the space 46 (see FIGS. 4 and 5) which is defined between two arms of the U-shaped antenna 52, i.e. battery 30. Such a configuration is successful in noticeably reducing the overall dimensions of the pager 50.

In operation, when the power switch 56 is closed, the pager 50 is brought into a waiting condition. Specifically, the U-shaped antenna 52 which is constituted by the negative polarity sheath portion 34 of the battery 30 is connected at its terminals 34*a* and 34*b* to the matching circuit 60 and thereby matched to the radio section 62. When an electromagnetic wave modulated by a signal of a desired frequency comes in through the antenna 52, it is demodulated by the radio section 62 and then converted into a digital signal by the wave-shaper 64. The digital signal is fed to the decoder 66. The decoder 66 compares the input digital signal with the paging number which is assigned to the pager 50 and, if they are coincident, drives the loudspeaker 72 via the buffer 70 to alert the user of the pager 50 to the reception of a call.

Figure 6:
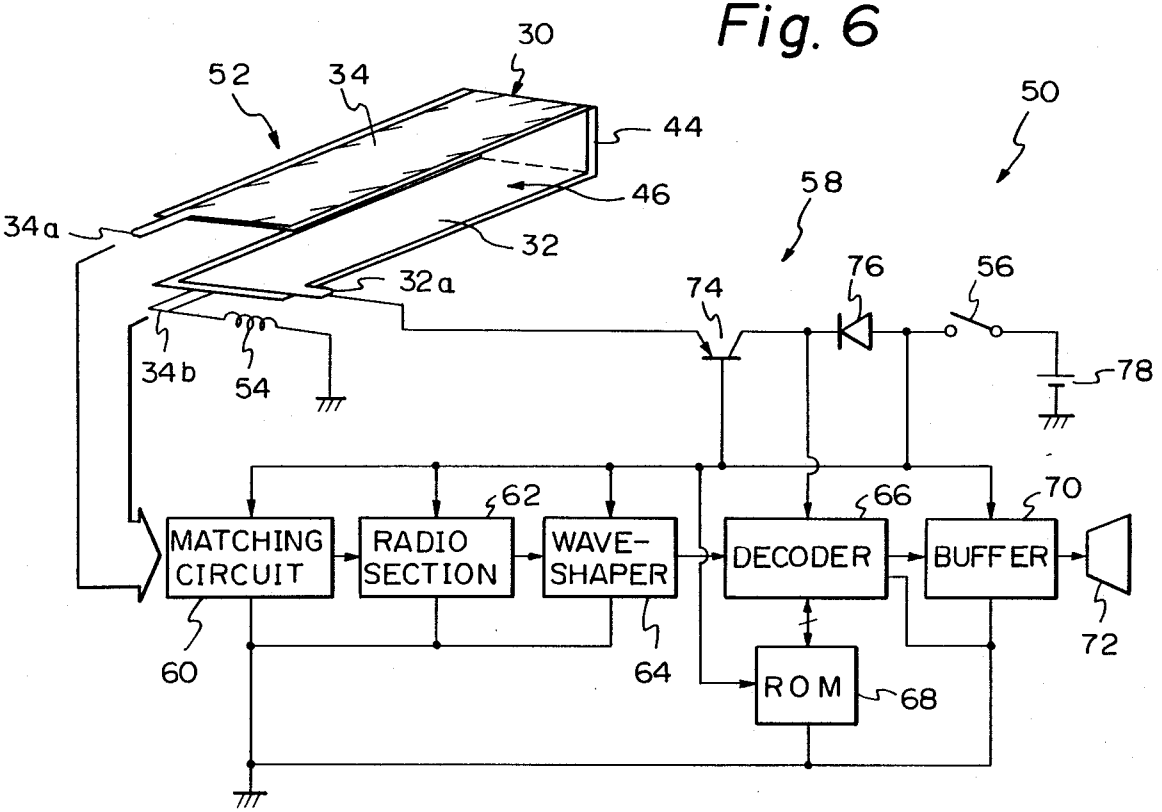
FIG. 6 is a view showing a modification to the apparatus of FIG. 5.

As shown in FIG. 6, the battery 30 which constitutes a part of the antenna 52 as shown in FIG. 4 may be used to back up a part of the circuit arrangement of the pager 50, e.g. decoder 66. In this case, a transistor 74 and a diode 76 are interposed between the positive terminal 32*a* of the battery 30 and the power switch 56. The power switch 56 is connected to ground through a battery 78. When the power switch 56 is open or when the battery 78 is not loaded with the switch 56 closed, power is fed from the combined antenna and battery 30 to the decoder 66 via the transistor 74. The rest of the construction and operation is the same as that of the embodiment shown in FIG. 4 and, therefore, will not be described to avoid redundancy.

Figure 7:
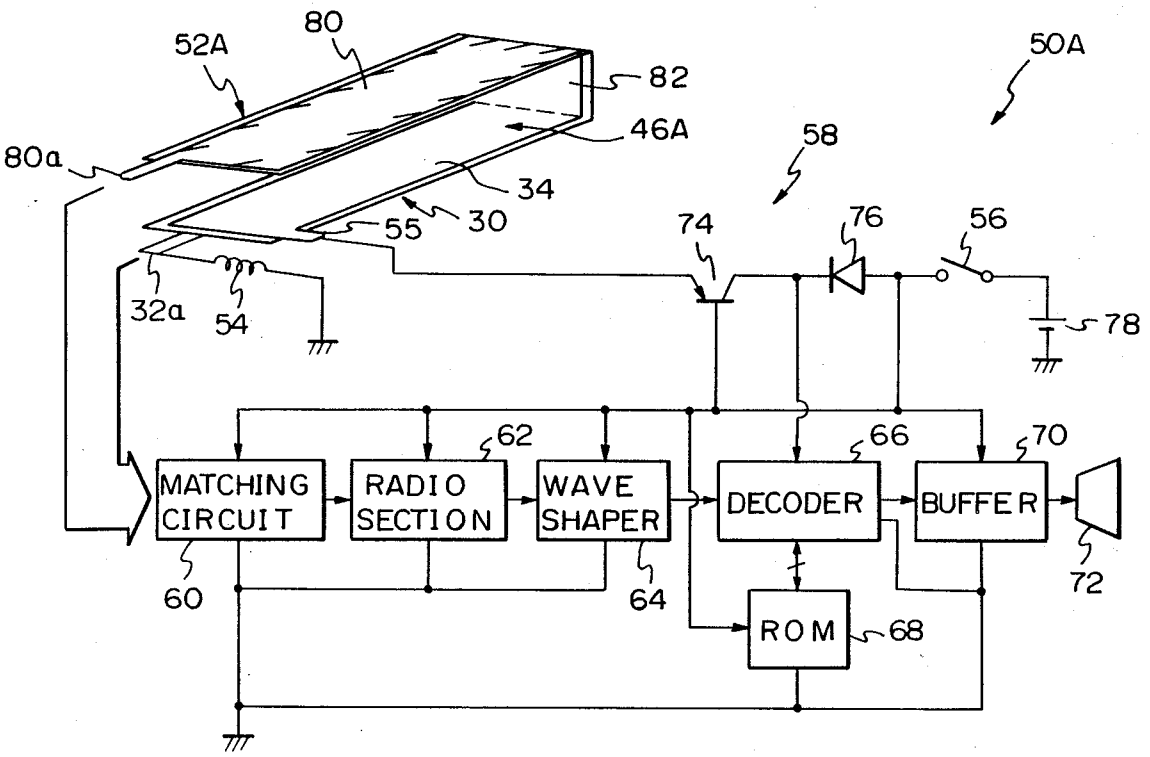
FIG. 7 is a view showing a second embodiment of the antenna in accordance with the present invention and a radio communication apparatus which it is installed.

Referring to FIG. 7, a radio communication apparatus (e.g. pager) 50A which is implemented by a second embodiment of the present invention is shown. The battery 30 used with the pages 50A is maintained flat as shown in FIGS. 2 and 3 and not bent at its intermediate portion. Specifically, an antenna 52A shown in FIG. 7 is formed in the shape of a letter U by the flat battery 30, a flat plate of metal 80 located to face the battery 30, and a connecting member 82 connecting the positive polarity sheath portion 32 of the battery 30 and the metal plate 80. In this configuration, therefore, the terminal 32*a* included in the positive terminal sheath portion 32 of the battery 30 and a terminal 80*a* included in the metal plate 80 serve as antenna terminals, i.e. feed points of the antenna 42A. Again, the circuit arrangement 58 is integrated and received in a space 46A which is defined between the metal plate 80 and the battery 30. The pager 50A is operated in the same manner as the pager 50 shown in FIG. 6.

Figure 8:
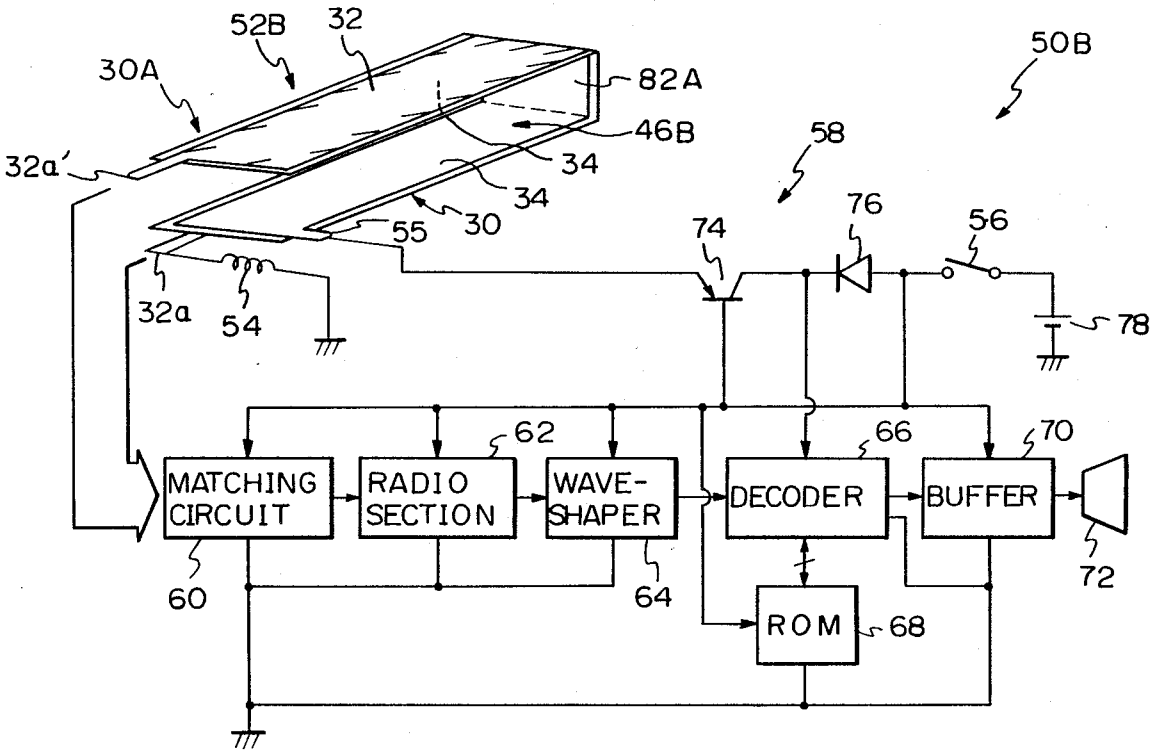
FIG. 8 is a view showing a third embodiment of the present invention and a radio communication apparatus in which it is installed.

FIG. 8 shows a radio communication apparatus (e.g. pager) 50B which is implemented by a third embodiment of the present invention. The pager 50B, like the pager 50A of FIG. 7, uses the battery 30 in the flat configuration as shown in FIGS. 2 and 3, the battery 30 constituting a part of the antenna 52B. Specifically, the antenna 52B includes the battery 30 and another battery 30A which replaces the metal plate 80 of FIG. 7. A conductor 82A is provided in place of the connecting member 82 of FIG. 7 for connecting the positive terminals and the negative terminals of the batteries 30 and 30A to each other. Hence, the antenna 52B is generally provided with a U shape as defined by the positive terminal sheath portion 32 of the battery 30, conductor 82A, and positive terminal sheath portion 32 of the battery 30A. The positive terminal sheath portions 32 of the batteries 30 and 30A are respectively provided with antenna terminals 32*a* and 32'*a* which define feed points. In this embodiment, the circuit 58 is also integrated and received in a space 46B between the batteries 30 and 30A. The operation of the pager 50B is the same as that of the pagers 50 and 50B previously stated.

While the illustrative embodiments of the present invention have been shown and described as using a flat ultrathin lithium battery of FIGS. 2 and 3, the miniaturization of a portable radio communication apparatus in accordance with the present invention is also achievable with a coil type or button type battery.

In summary, it will be seen that the present invention successfully miniaturizes a portable radio communication apparatus by using a conductive sheath portion of a flat thin battery as at least a part of a conductor which constitutes an antenna of the apparatus.

Various modifications will become possible for those skilled in the art after receiving the teachings of the present disclosure without departing from the scope thereof.

What is claimed is:

1. In an antenna of a radio communication apparatus which is powered by at least one generally flat battery with positive and negative terminals, the improvement wherein at least one flat part of said antenna is integrally constituted by a flat conductive sheath member which comprises a flat portion of said battery.

2. An antenna as claimed in claim 1, wherein said apparatus uses a single battery, said battery and said flat conductive sheath member comprised therein being bent generally in the form of a letter U to form a loop.

3. An antenna as claimed in claim 2, wherein said conductive sheath member constitutes one of a positive terminal and a negative terminal of said battery.

4. An antenna as claimed in claim 2, wherein and antenna terminal is provided at each of opposite ends of said conductive sheath member to define antenna feed points.

5. An antenna as claimed in claim 4, wherein an electric circuit of said apparatus is received in a space which is defined between opposite arms of said conductive sheath member.

6. An antenna as claimed in claim 5, wherein said conductive sheath member is electrically connected to said electric circuit of said apparatus.

7. An antenna as claimed in claim 6, wherein at least one of said antenna terminals is grounded to said apparatus via an element having a high impedance to a reception frequency of said apparatus.

8. An antenna as claimed in claim 7, wherein said element comprises a coil.

9. An antenna as claimed in claim 1, wherein said apparatus has a single battery, said conductive sheath member having the form of a single flat plate which constitutes such flat part of said antenna.

10. An antenna as claimed in claim 9, wherein said antenna comprises said conductive sheath member of said battery; a flat conductor facing and spaced from said conductive sheath member; and a conductive connecting member connecting one end of said sheath member and one end of said flat conductor to each other; whereby said sheath member, said flat conductor and said connecting member form a U-shape.

11. An antenna as claim in claim 10, wherein the ends of said conductive sheath member and said flat conductor away from said connecting member are reach provided with an antenna terminal which defines an antenna feed point.

12. An antenna as claimed in claim 11, wherein an electric circuit of said apparatus is accommodated in a space which is defined between said conductive sheath member and said flat conductor.

13. An antenna as claimed in claim 12, wherein said conductive sheath member is electrically connected to said electric circuit of said apparatus.

14. An antenna as claimed in claim 13, wherein at least one of said antenna terminals is grounded to said apparatus via an element having a high impedance to a reception frequency of said apparatus.

15. An antenna as claimed in claim 14, wherein said element comprises a coil.

16. An antenna as claimed in claim 1, wherein said apparatus has first and second batteries having first and second flat conductive sheath members. Respectively, said first and second conductive sheath members each having the form of a single flat plate 17. An antenna as claimed in claim 16, wherein said antenna comprises said first and second conductive sheath members of said batteries and a conductive connecting member connecting the poles of said batteries with the same polarity to each other.

18. An antenna as claimed in claim 17, wherein said first and second conductive sheath members of said batteries are each provided with an antenna terminal which defines an antenna feed point.

19. An antenna as claimed in claim 18, wherein an electric circuit of said apparatus is received in a space which is defined between said batteries.

20. An antenna as claimed in claim 19, wherein one of said first and second conductive sheath members of said batteries is electrically connected to said circuit.

21. An antenna as claimed in claim 20, wherein at least one of said antenna terminals is grounded to said apparatus via an element having a high impedance to a reception frequency of said apparatus.

22. An antenna as claimed in claim 21, wherein said element comprises a coil.

23. An antenna in a radio communication apparatus comprising:

a flat conductive sheath member which is included in a first battery powering said apparatus, said conductive sheath member integrally forming at least one flat part of said antenna and of a housing accommodating an electrical circuit of said apparatus; and connecting means for connecting said conductive sheath member to an antenna matching circuit of said apparatus.

24. An antenna as claimed in claim 23, wherein said apparatus is further powered by a second battery, and means for connecting said first battery to said apparatus so as to function as a back-up battery for said second battery.

25. A method of forming an antenna of a radio communication apparatus comprising the steps of:

connecting positive and negative terminal sheath members of a flat thin battery to positive and negative battery terminals of said apparatus, respectively;

connecting one of said positive and negative sheath members to an antenna matching circuit of said apparatus; and employing at least a part of said flat thin battery to form at least one flat part of an antenna of said apparatus and to define a space for accommodating an electrical circuit of said apparatus therein.

* * * * *